US009339693B1

(12) United States Patent
Pegram, II et al.

(10) Patent No.: US 9,339,693 B1
(45) Date of Patent: May 17, 2016

(54) WEIGHT LIFTING STRAP WITH EQUIPMENT ENGAGEMENT SYSTEM

(71) Applicants: R. Ryan Pegram, II, Henderson, CO (US); Jason J. Pederson, Thornton, CO (US)

(72) Inventors: R. Ryan Pegram, II, Henderson, CO (US); Jason J. Pederson, Thornton, CO (US)

( * ) Notice: Subject to any disclaimer, the term of this patent is extended or adjusted under 35 U.S.C. 154(b) by 66 days.

(21) Appl. No.: 13/633,740

(22) Filed: Oct. 2, 2012

(51) Int. Cl.
*A63B 26/00* (2006.01)

(52) U.S. Cl.
CPC ..... *A63B 26/00* (2013.01)

(58) Field of Classification Search
CPC .. A41D 19/00; A63B 26/00; A63B 21/00003; A63B 21/0004; A63B 21/00083; A63B 21/00094; A63B 21/00101; A63B 21/00109; A63B 21/0013; A63B 21/00134; A63B 21/00138; A63B 21/00167; A63B 21/0017; A63B 21/00174; A63B 21/065; A63B 21/068; A63B 21/072; A63B 21/0728; A63B 21/08; A63B 21/1403; A63B 21/1434; A63B 21/1438; A63B 21/1442; A63B 21/1446; A63B 21/1449; A63B 21/1465; A63B 21/1469; A63B 21/1476; A63B 21/15; A63B 21/151; A63B 23/12; A63B 23/1209; A63B 23/1245; A63B 23/1281; A63B 23/14; A63B 29/08; A63B 71/14; A63B 71/141; A63B 2244/09
USPC ..... 482/92, 139
See application file for complete search history.

(56) References Cited

U.S. PATENT DOCUMENTS

| | | | | |
|---|---|---|---|---|
| 597,438 | A | | 1/1898 | Schilling |
| 673,830 | A | | 5/1901 | Wade |
| 929,173 | A | | 7/1909 | Stone |
| 2,278,610 | A | | 4/1942 | Brownson et al. |
| 3,536,368 | A | | 10/1970 | Stubbs |
| 3,554,554 | A | | 1/1971 | Zane |
| 4,109,908 | A | | 8/1978 | Pugh et al. |
| 4,447,912 | A | | 5/1984 | Morrow |
| 4,484,740 | A | | 11/1984 | Green |
| 4,487,412 | A | | 12/1984 | Meeko |
| 4,684,122 | A | | 8/1987 | Desmond et al. |
| 4,698,850 | A | * | 10/1987 | Patton et al. ..... 2/159 |
| 4,720,279 | A | | 1/1988 | Fritschen et al. |
| 4,793,005 | A | | 12/1988 | Hetzel, Jr. |
| 4,807,876 | A | * | 2/1989 | Lothar ..... 482/139 |
| 4,809,974 | A | * | 3/1989 | Buhr ..... 482/139 |
| 5,004,231 | A | | 4/1991 | Alread |
| 5,298,001 | A | * | 3/1994 | Goodson ..... 482/23 |
| 5,324,244 | A | | 6/1994 | Miller et al. |
| 5,350,343 | A | * | 9/1994 | DaSilva ..... 482/106 |
| 5,353,440 | A | * | 10/1994 | Meldeau ..... 2/161.1 |
| 5,634,213 | A | * | 6/1997 | Grover ..... 2/161.1 |
| 5,685,809 | A | * | 11/1997 | Murray ..... 482/105 |
| 5,745,920 | A | | 5/1998 | Olivier |
| 5,746,685 | A | | 5/1998 | Glaser |
| 5,809,570 | A | | 9/1998 | Grover |
| 5,846,168 | A | * | 12/1998 | Murray ..... 482/105 |
| 5,864,884 | A | | 2/1999 | Salvitti |
| 5,888,180 | A | | 3/1999 | Dewberry |

(Continued)

*Primary Examiner* — Oren Ginsberg
*Assistant Examiner* — Gary D Urbiel Goldner

(57) ABSTRACT

A device for supporting or attaching to exercise equipment, such as free-weights or machines is disclosed. The device includes an elongated strap that supports a generally C-shaped hook that has a pair of generally parallel limbs. The C-shaped hook is attached to the elongated strap such that the limbs of the C-shaped hook are generally parallel to the length of the elongated strap. Additionally, a safety mechanism that prevents items held within the C-shaped hook is also disclosed.

13 Claims, 2 Drawing Sheets

(56) References Cited

U.S. PATENT DOCUMENTS

| | | | | |
|---|---|---|---|---|
| 5,898,944 | A * | 5/1999 | Vrany | 2/161.4 |
| 5,997,494 | A | 12/1999 | Watkins et al. | |
| 6,168,556 | B1 | 1/2001 | Saavedra | |
| 6,183,400 | B1 | 2/2001 | Pope | |
| D459,772 | S | 7/2002 | Meldeau | |
| D464,686 | S | 10/2002 | Silveira et al. | |
| 6,666,795 | B2 * | 12/2003 | Mah | 482/23 |
| 6,834,397 | B1 * | 12/2004 | Murphy | 2/161.1 |
| 6,849,036 | B2 | 2/2005 | Forslid | |
| 7,008,355 | B2 | 3/2006 | Emick | |
| 7,051,377 | B1 | 5/2006 | Milner et al. | |
| D609,758 | S | 2/2010 | Baldwin | |
| 7,662,073 | B1 | 2/2010 | Baldwin | |
| 7,896,414 | B1 | 3/2011 | Brigham | |
| 7,946,967 | B2 | 5/2011 | Berhanu | |
| D655,080 | S | 3/2012 | Burrows | |
| 2003/0148861 | A1 * | 8/2003 | McBride | 482/92 |
| 2005/0075227 | A1 * | 4/2005 | Emick | 482/139 |
| 2005/0255973 | A1 | 11/2005 | Ward | |
| 2006/0084557 | A1 * | 4/2006 | Kassel et al. | 482/139 |
| 2008/0090705 | A1 * | 4/2008 | Wang | 482/106 |
| 2009/0275448 | A1 * | 11/2009 | Fishman | 482/139 |
| 2011/0203026 | A1 | 8/2011 | Maisari | |

* cited by examiner

WEIGHT LIFTING STRAP WITH EQUIPMENT ENGAGEMENT SYSTEM

BACKGROUND OF THE INVENTION (a) Field of the Invention

This application relates to a device and system for engaging various exercise equipment and carrying out various exercises with this equipment. More particularly, but not by way of limitation, to a device that is worn about a user's wrists, and which accepts a connector mechanism that can accept various devices for carrying out exercises.

(b) Discussion of Known Art

The need to facilitate the gripping and support of items to be lifted or pulled by hand has been long recognized. Well-known approaches at providing a device that may be argued to help meet this need are found in U.S. Pat. No. 5,809,570 to Grover, U.S. Pat. No. 5,324,244 to Miller et al., and D464,686 to Silveira et al.

The Miller et al. device includes a strap that is adapted to extend around the user's wrist and then around a weight, so that the user can grip the strap and the weight can be lifted at the same time. This approach is similar to the approach taken by Grover, who provides a pair of straps that mount from a wrist strap and then to one another to assist the user in supporting the weight. A significant limitation to the approaches of Grover and Miller et al. is that both depend on the user's grip to keep the weight from falling.

U.S. Pat. No. D464,686 to Silveira et al. provides a hook attachment that is sewn to a wrist strap through a short tether, and the wrist strap is then used to support the assembly from the user's wrist. While the Silveira et al. prevents the undesired falling of the weight through the use of a tethered hook, the tether for the hook is of a fixed length, and therefore the device must be made with various tether lengths in order to allow a proper fit for different sized users.

Others have provided wraps that allow the user to wrap the weight to be lifted to his wrists. This approach has the clear disadvantage that a user will have a relatively easy time wrapping a first hand to the weight, and then have a difficult time properly wrapping another weight to the remaining hand due to the fact that the first hand has been wrapped to a weight.

Accordingly, there remains a need for a weight support device that allows a user to quickly and safely secure weight-lifting equipment or other equipment to the user's hands, wrists, or forearms.

BRIEF SUMMARY OF THE INVENTION

It has been discovered that the problems left unanswered by known art can be solved by providing a device for attaching or supporting exercise equipment from a person's limb, such as an arm or wrist. A highly preferred example of the device includes:

- An elongated strap with a first end, a second end, and a lower side edge;
- a D-ring or buckle that is attached to the second end of the strap, so that the strap may be wrapped around the arm or wrist, and then the first end of the strap may be slipped through the buckle and wrapped or cinched around the arm or wrist; and
- a generally C-shaped hook that has a pair of generally parallel limbs that are held in a fixed, spaced apart, relationship from one another by a support section that is preferably of unitary, one-piece, construction with the pair of generally parallel limbs. The C-shaped hook is attached to the second end of the elongated strap such that the limbs of the C-shaped hook are generally parallel to the length of the elongated strap, so that the parallel limbs of the C-shaped hook are generally perpendicular to the arm when attached to the arm or wrist.

According to a highly preferred embodiment of the invention, the C-shaped hook has an elongated upper limb and an elongated lower limb that are separated by an elongated gap. The limbs are joined through a support section that retains the relationship of the elongated upper limb and the elongated lower limb.

The lower limb will preferably also include a lower limb tip that has a tip protrusion that extends from the lower limb towards the upper limb, thus narrowing the elongated gap between the lower limb and the upper limb. The narrowing of the elongated gap will help retain items that are being lifted or pulled with the C-shaped hook.

Still further, it has been discovered that items can be prevented from slipping out of the elongated gap by placing the item within the C-shaped hook at a location between the flat elongated strap and a backing pad, such that a portion of the flat elongated strap extends over a portion of the tip protrusion. The flexibility of the material of the elongated strap will allow the user to remove items from the elongated gap by moving the lower side edge of the elongated strap away from the tip protrusion, and thus clearing access to the elongated gap.

Preferably, the attachment of the upper limb of the C-shaped hook to the elongated strap will be accomplished through the use of a first hook attachment strap and a second hook attachment strap. The first hook attachment strap and the second hook attachment strap will cooperate with the upper limb of the C-shaped hook to prevent the C-shaped hook from rotating about an axis that is perpendicular to the plane of the C-shaped hook.

It should also be understood that while the above and other advantages and results of the present invention will become apparent to those skilled in the art from the following detailed description and accompanying drawings, showing the contemplated novel construction, combinations and elements as herein described, and more particularly defined by the appended claims, it should be clearly understood that changes in the precise embodiments of the herein disclosed invention are meant to be included within the scope of the claims, except insofar as they may be precluded by the prior art.

DRAWINGS

The accompanying drawings illustrate preferred embodiments of the present invention according to the best mode presently devised for making and using the instant invention, and in which.

DETAILED DESCRIPTION OF PREFERRED EXEMPLAR EMBODIMENTS

While the invention will be described and disclosed here in connection with certain preferred embodiments, the description is not intended to limit the invention to the specific embodiments shown and described here, but rather the invention is intended to cover all alternative embodiments and modifications that fall within the spirit and scope of the invention as defined by the claims included herein as well as any equivalents of the disclosed and claimed invention.

Figure 1:
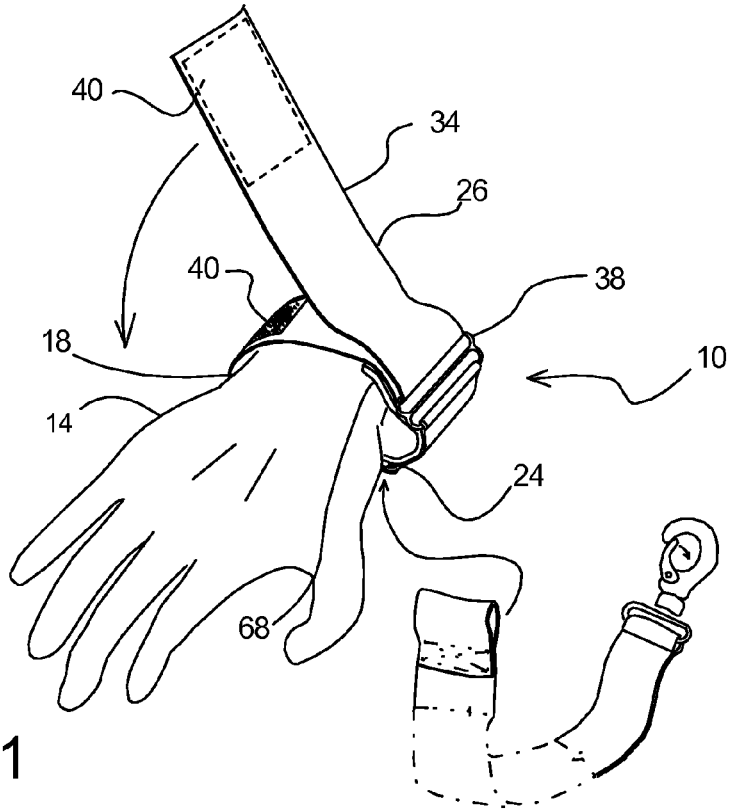
FIG. 1 shows the invention being attached to a user's wrist.
Figure 2:
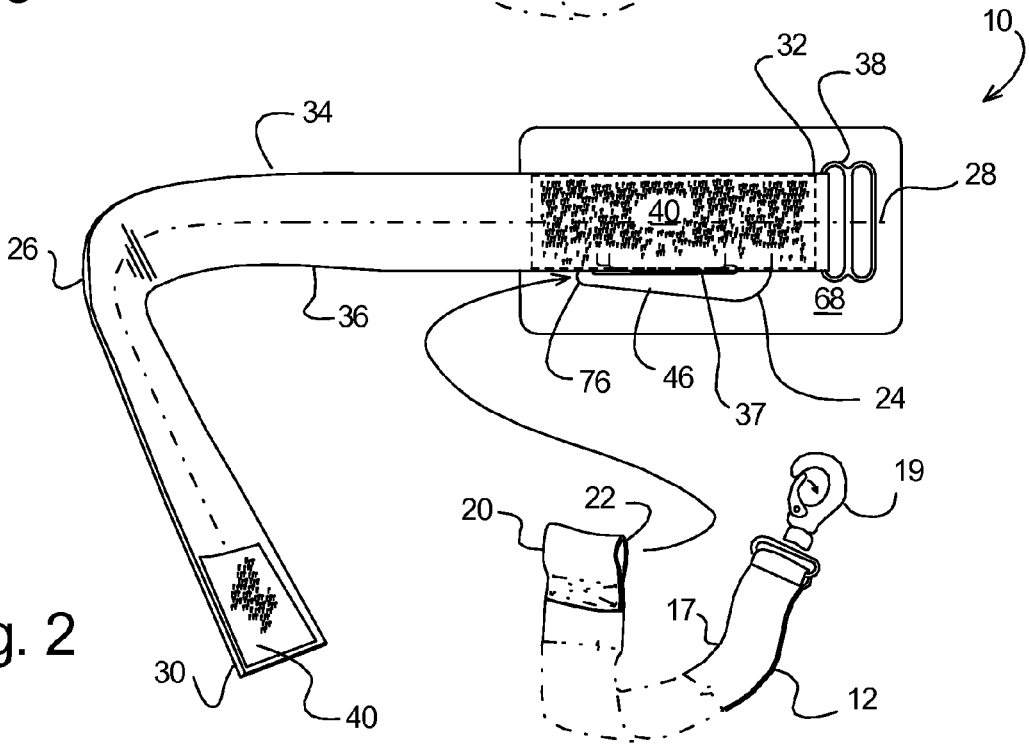
FIG. 2 shows the disclosed invention with the flat elongated strap slightly bent, and illustrates the preferred positioning of the hook and loop material, as well as the C-shaped hook and other important components of the disclosed invention.

Attention is drawn now to FIG. 1, where an exercise device 10 including inventive aspects disclosed here has been illustrated. The exercise device 10 is particularly useful for attaching or supporting exercise equipment 12 from a limb 14 of a person 16 in use. The exercise equipment 12 shown in FIG. 1 is a strap 17 with a snap hook 19 that is used for connecting to weights or to a weight machine, for example. Attachment of the exercise equipment 12 is preferably accomplished by providing a connector 20 with a sleeve 22 or looped section. The connector 20 cooperates with a C-shaped hook 24 on the exercise device 10. FIGS. 1 and 2 also show that C-shaped hook 24 is preferably positioned at the second end 32 of the elongated strap 26.

Figure 3:
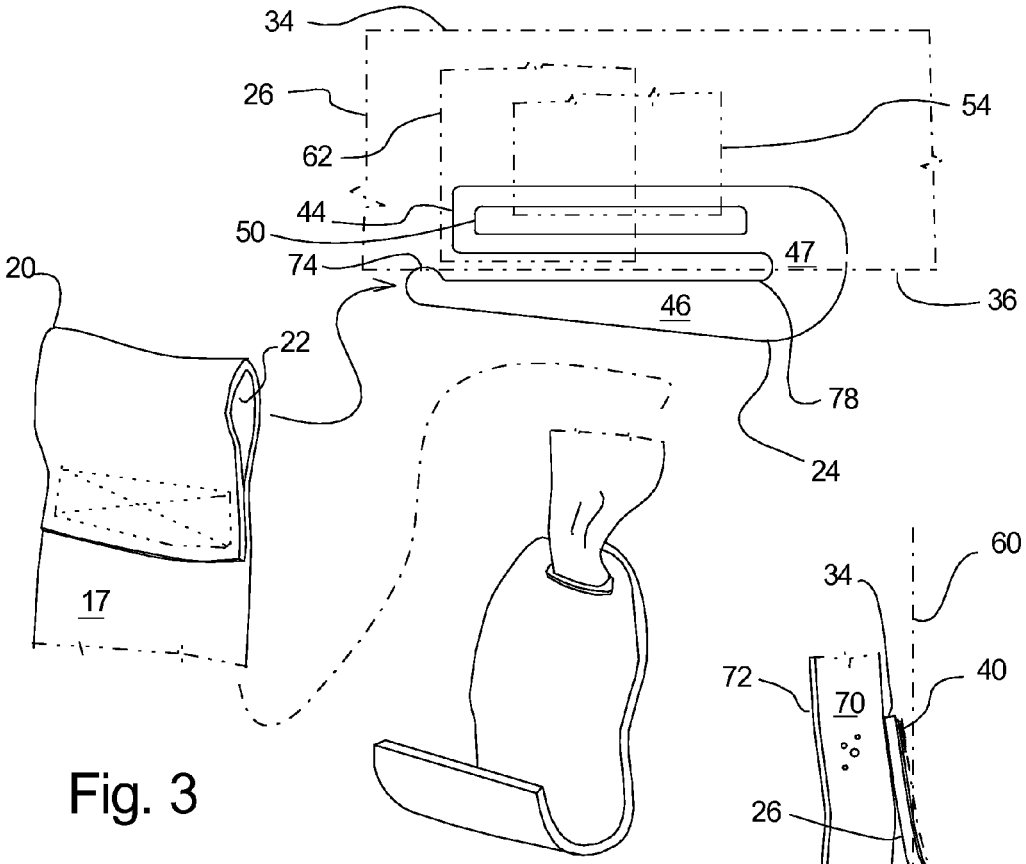
FIG. 3 illustrates the connector and sleeve used with the disclosed invention, as well as a plan-view of the C-shaped hook and the outline and positioning of the attachment straps used to support the C-shaped hook.

As shown in FIGS. 2 and 3, the exercise device 10 includes a flat elongated strap 26 that extends along an axis 28. The term "flat" as used here should not be limited to meaning absolutely planar. It is contemplated that padding may be incorporated into the flat elongated strap 26, so the term "flat" must be interpreted as encompassing straps that provide padding as well as sheet-like materials. The flat elongated strap 26 is used to support the C-shaped hook 24, and includes a first end 30, a second end 32, an upper side edge 34 and a lower side edge 36. The upper side edge 34 and the lower side edge 36 extend between the first end 30 and the second end 32 of the flat elongated strap 26. While in the preferred example of the invention the side edges 34 and 36 will be generally straight and parallel to one another, it is also contemplated that these edges may be curved so as to accommodate anatomy of the user or to improve load paths, for example. However, for reasons explained below, it is preferred that at least a portion 37 of the lower side edge 36 should be generally straight and generally parallel to the axis 28 of the flat elongated strap 26. This parallel portion 37 is used to retain items being supported from the C-shaped hook 24, and thus the parallel portion 37 should be at a location where the C-shaped hook 24 is mounted to the flat elongated strap 26.

Additionally, the accompanying FIGS. 2 and 3 show that a D-ring, or as illustrated in the preferred example, a double D-ring 38 is attached to the second end 32. While it is contemplated that other types of buckles, such as a frame-and-prong type buckle, may be used instead of a double D-ring buckle 38, the use of a D-ring mechanism along with sections of hook and loop material 40 are preferred. The hook and loop material 40 is attached to sections of the elongated strap 26 near the first end 30 and the second end 32 are preferred due to the precise adjustment permitted by hook and loop material. Thus, referring to FIGS. 1 and 2, it will be understood that to attach the elongated strap 26 to a user's wrist, the user would simply places the second end 32 of the elongated strap 26 over the wrist area, and then bring the first end 30 of the strap around the wrist area. The first end 30 would then be inserted through the double D-ring 38 and cinched or pulled against the double D-ring 38 tighten the strap around the wrist area. Once the desired tightness is achieved, the user simply presses the hook and loop material 40 that is found on the first end 30 against the mating hook and loop material 40 found on the second end 32, and thus securely fastening the elongated strap around the limb 14.

Figure 4:
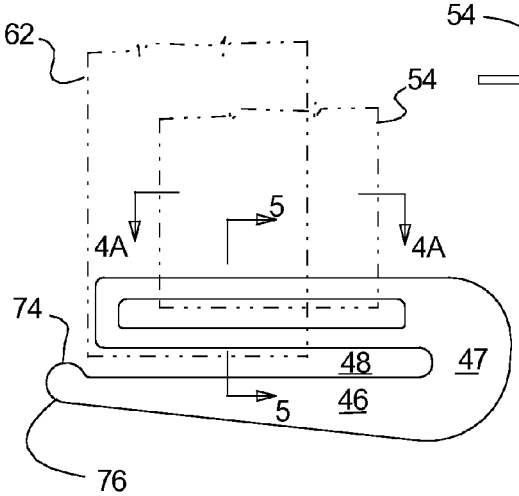
FIG. 4 is another plan-view of the C-shaped hook and the outline and positioning of the attachment straps used to support the C-shaped hook, the view also showing the location of section views shown in FIGS. 4A and 5.
Figure 5:
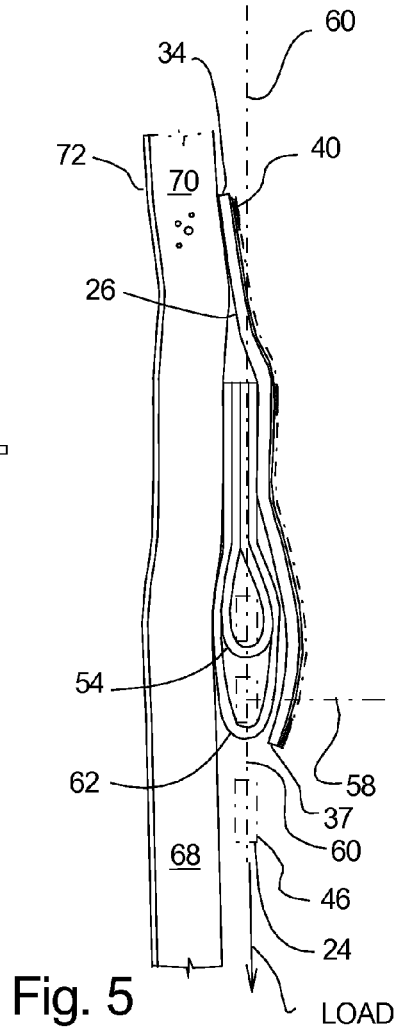
FIG. 5 is a section taken at the location and in the direction indicated by arrows 5-5 in FIG. 4, and shows the cooperation of the planar body of the c-shaped hook and the first hook attachment strap and the second hook attachment strap.

Referring now to FIGS. 3-5, it will be understood that the C-shaped hook 24 includes an elongated upper limb 44 that is generally parallel to an elongated lower limb 46. A support section 47 retains lower limb 46 in the desired spaced-apart relationship from upper limb 44. In the preferred example of the invention, the support section 47 is of unitary, one-piece, construction with the lower limb 46 and the upper limb 44. An elongated gap 48 is found between the upper limb 44 and the lower limb 46. The elongated gap 48 serves to accept the exercise equipment connector 20, such that the lower limb 46 would be inserted into or through sleeve 22 of the connector 20.

Figure 4A:
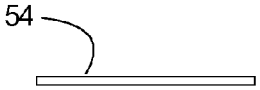
FIG. 4A is a section taken at the location and in the direction indicated by arrows 4A-4A in FIG. 4, and shows the flat, elongate cross-section of the first hook attachment strap.

FIGS. 3-5 also illustrate that in a preferred example of the disclosed invention, the upper limb 44 includes at least one aperture 50 for accepting a connector 52, such as a sown strap or ribbon, which is used for attaching the upper limb 44 to the elongated strap 26. In a highly preferred example of the invention, the C-shaped hook 24 is attached to the elongated strap 26 though the use of a first hook attachment strap 54. As illustrated in FIG. 4A, the first hook attachment strap 54 includes an elongated cross-section 56. The use of an elongated cross-section 56 on the first hook attachment strap 54 allows the first hook attachment strap 54 to cooperate with the aperture 50 to prevent the C-shaped hook 24 from rotating about an axis 58 that is perpendicular to the flat elongated strap 26 or to the plane 60 of the C-shaped hook 24, as illustrated in FIG. 5. It is contemplated that studs, rivets, or even stitching, may be used to attach the upper limb 44 to the flat elongated strap 26. However, strap material with an elongated cross-section has been selected due to its effectiveness and simplicity of fabrication.

FIGS. 3, 4 and 5 also illustrate that it is contemplated that a second hook attachment strap 62 will be used with the disclosed invention to further secure the C-shaped hook 24 against the flat elongated strap 26, and to further reduce the possibility of rotation of the C-shaped hook 24 about the axis 58. The second hook attachment strap 62 will extend around the upper limb 44, and over at least a portion of the first hook attachment strap 54. It has been found that by having the second hook attachment strap 62 extend over the first hook attachment strap 54 and over the upper limb 44 will allow the second hook attachment strap 62 to cooperate with the upper limb 44 and the first hook attachment strap 54 in preventing the C-shaped hook from rotating about the axis 58. Accordingly, this arrangement will keep the lower limb 46 in a generally parallel orientation relative to the flat elongated strap 26, and thus preventing exercise equipment from unintentionally sliding out of the elongated gap 48 when not desired.

Referring to FIGS. 1 and 3, it will be understood that it is also contemplated that instead of mounting the C-shaped hook 24 from the elongated strap 26, one may use the principles discussed herein to mount the C-shaped hook 24 from the strap 17 of a device that is used to attach to exercise equipment, such as the device referred to as exercise equipment 12 in FIG. 1. To this arrangement one may provide straps that provide a cooperating side edge, such as side edge 36, and attachment straps such as first hook attachment strap 54 and the second hook attachment strap 62. In order to use this arrangement, a mating sleeve, such as sleeve 22, would be mounted from the elongated strap 26 that would then be wound around the user's wrist.

FIGS. 1, 2, and 5 also show that a preferred example of the disclosed invention uses a backing pad 68 that is attached to the flat elongated strap 26. The backing pad 68 is arranged such that at least part of the C-shaped hook 24 extends between the backing pad 68 and the flat elongated strap 26. The backing pad 68 is intended to provide cushioning of any loads that are transmitted from the C-shaped hook 24 towards the limb 14 of the user, and also cooperates with the flat elongated strap 26 in stabilizing the exercise device 10 when lower limb 46 of the generally C-shaped hook 24 supports a load in a cantilevered manner as shown in FIG. 5. In a preferred example of the invention, the backing pad 68 is made from a neoprene rubber 70 with a suitable fabric backing 72, and extends from the elongated strap 26 and next to the C-shaped hook 24, such that the entire C-shaped hook 24 is supported over the backing pad 68 when the disclosed invention is properly mounted from a person's limb 14.

Accordingly, the disclosed invention provides a safety mechanism that uses the cooperation of the lower side edge 36 and a tip protrusion 74 extends from the lower limb 46 to prevent the unintentional released of items supported from C-shaped hook 24 of the exercise device 10. To create the safety mechanism, the lower limb 46 will end in a lower limb tip 76 and the tip protrusion 74 will extend from the lower limb 46 towards the upper limb 44, such that the tip protrusion fills a portion of the elongated gap 48 between the lower limb 46 and the upper limb 44. This arrangement will create a closed perimeter 78 that is bounded by the lower limb 46, the tip protrusion 74, the support section 47, and the lower side edge 30, and so that the lower side edge 30 of the flat elongated strap 26 cooperates with the tip protrusion 74 to retain items within the closed perimeter 78.

Thus, it can be appreciated that the above-described embodiments are illustrative of just a few of the numerous variations of arrangements of the disclosed elements used to carry out the disclosed invention. Moreover, while the invention has been particularly shown, described and illustrated in detail with reference to preferred embodiments and modifications thereof, it should be understood that the foregoing and other modifications are exemplary only, and that equivalent changes in form and detail may be made without departing from the true spirit and scope of the invention as claimed, except as precluded by the prior art.

What is claimed is:

1. An exercise device for attaching exercise equipment from a limb of a person, the exercise device comprising:

a flat elongated strap that extends along an axis and further comprises a first end, a second end, an upper side edge and a lower side edge, the upper side edge and the lower side edge extending between the first end and the second end;

a buckle that is attached to the second end of the flat elongated strap, so that the first end of the flat elongated strap may be extended through the buckle to provide for adjustment of the flat elongated strap around the limb of the person;

a planar generally C-shaped hook, the planar generally C-shaped hook having an elongated upper limb and an elongated lower limb that is spaced apart from and generally parallel with the elongated upper limb to define an elongated gap between the elongated upper limb and the elongated lower limb, the elongated lower limb being adapted for supporting a load in a cantilevered manner, the elongated upper limb having at least one aperture for accepting a connector for attaching the elongated upper limb to the flat elongated strap at a location near the second end of the flat elongated strap such that the at least one aperture inhibits rotation of the planar generally C-shaped hook relative to the flat elongated strap, the elongated upper limb and the elongated lower limb being attached to one another through a support section that retains the spaced apart relationship of the elongated upper limb relative to the elongated lower limb, the elongated upper limb being secured against the flat elongated strap such that the elongated lower limb is generally parallel to the flat elongated strap, so that exercise equipment may be mounted from the elongated lower limb while the flat elongated strap is attached around the limb of the person.

2. The exercise device according to claim 1 wherein the at least one aperture for accepting a connector for attaching the elongated upper limb is elongated, and the planar generally C-shaped hook is attached to the flat elongated strap with a first hook attachment strap with an elongated cross-section, so that the elongated cross-section of the first hook attachment strap cooperates with the at least one aperture to prevent the planar generally C-shaped hook from rotating about the flat elongated strap.

3. The exercise device according to claim 2 wherein said lower side edge is generally parallel to said axis, and said elongated gap is retained generally parallel to the lower side edge by said first hook attachment strap.

4. The exercise device according to claim 3 and further comprising a backing pad, the backing pad being attached to the flat elongated strap such that at least part of the planar generally C-shaped hook extends between the backing pad and the flat elongated strap.

5. The exercise device according to claim 4 wherein said planar generally C-shaped hook is generally planar, and said backing pad extends from the flat elongated strap and next to the planar generally C-shaped hook, such that the entire planar generally C-shaped hook is supported over the backing pad.

6. The exercise device according to claim 5 wherein said elongated lower limb extends from said support section and ends in a lower limb tip, the elongated lower limb tip having a tip protrusion that extends from the elongated lower limb towards the elongated upper limb, so that the tip protrusion fills a portion of the elongated gap between the elongated lower limb and the elongated upper limb.

7. The exercise device according to claim 6 wherein said tip protrusion extends from the elongated lower limb towards the elongated upper limb and ends against the lower side edge, so that a closed perimeter is created between the elongated lower limb, the tip protrusion, the support section, and the lower side edge, and so that the lower side edge of the flat elongated strap cooperates with the tip protrusion to retain items within the closed perimeter.

8. The exercise device according to claim 7 and further comprising a second hook attachment strap, the second hook attachment strap extending over the first hook attachment strap and over the elongated upper limb, so that the second hook attachment strap cooperates with the elongated upper limb and the first hook attachment strap to prevent the planar generally C-shaped hook from rotating.

9. An exercise device for attaching exercise equipment from a limb of a person, the exercise device comprising:

a flat elongated strap that extends along an axis and further comprises a first end, a second end, an upper side edge and a lower side edge, the upper side edge and the lower side edge extending between the first end and the second end;

a buckle that is attached to the second end of the flat elongated strap, so that the first end of the flat elongated strap may be extended through the buckle to provide for adjustment of the flat elongated strap around the limb of the person;

a planar generally C-shaped hook, the planar generally C-shaped hook having an elongated upper limb and an elongated lower limb, the elongated lower limb being adapted for supporting a load in a cantilevered manner and the load being connected to the exercise equipment, the elongated lower limb being spaced apart from and fixedly attached in a generally parallel configuration to the elongated upper limb to define an elongated gap between the elongated upper limb and the elongated lower limb, the elongated upper limb being fixedly attached to the flat elongated strap such that the elongated lower limb is generally parallel to the flat elongated strap, and the elongated upper limb and the elongated lower limb extending along a plane, so that the exercise equipment may be mounted from the elongated lower limb while the flat elongated strap is attached around the limb of the person.

10. The exercise device according to claim 9 wherein said elongated lower limb ends in a lower limb tip, the lower limb tip having a tip protrusion that extends from the elongated lower limb towards the elongated upper limb, so that the tip protrusion covers a portion of the elongated gap between the elongated lower limb and the elongated upper limb.

11. The exercise device according to claim 10 wherein said tip protrusion extends from the elongated lower limb towards the elongated upper limb and ends against the lower side edge of the flat elongated strap, so that a closed perimeter is created between the elongated lower limb, the tip protrusion, and the lower side edge, and so that the lower side edge of the flat elongated strap cooperates with the tip protrusion to retain items within the closed perimeter.

12. The exercise device according to claim 11 wherein said elongated upper limb includes a slotted aperture that accepts a first hook attachment strap with an elongated cross-section, the first hook attachment strap extending through the slotted aperture in the elongated upper limb and over a portion of the elongated upper limb, and attached to the second end of the flat elongated strap, so that the elongated upper limb is retained against the flat elongated strap by the first hook attachment strap.

13. The exercise device according to claim 12 and further comprising a second hook attachment strap, the second hook attachment strap extending over the first hook attachment strap and over the elongated upper limb, so that the second hook attachment strap cooperates with the elongated upper limb and the first hook attachment strap to prevent the planar generally C-shaped hook from rotating about the plane of the planar generally C-shaped hook.

* * * * *